US010573967B2

(12) United States Patent
Hsu

(10) Patent No.: US 10,573,967 B2
(45) Date of Patent: Feb. 25, 2020

(54) ANTENNA STRUCTURE

(71) Applicant: Wistron NeWeb Corp., Hsinchu (TW)

(72) Inventor: Chieh-Sheng Hsu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 307 days.

(21) Appl. No.: 15/853,347

(22) Filed: Dec. 22, 2017

(65) Prior Publication Data

US 2019/0081400 A1 Mar. 14, 2019

(30) Foreign Application Priority Data

Sep. 8, 2017 (TW) ..... 106130794 A

(51) Int. Cl.

| | |
|---|---|
| ***H01Q 5/35*** | (2015.01) |
| ***H01Q 9/04*** | (2006.01) |
| ***H01Q 5/378*** | (2015.01) |
| ***H01Q 25/00*** | (2006.01) |
| *H01Q 1/24* | (2006.01) |

(52) U.S. Cl.

CPC ..... *H01Q 5/35* (2015.01); *H01Q 5/378* (2015.01); *H01Q 9/045* (2013.01); *H01Q 9/0414* (2013.01); *H01Q 9/0421* (2013.01); *H01Q 9/0428* (2013.01); *H01Q 25/001* (2013.01); *H01Q 1/243* (2013.01)

(58) Field of Classification Search

CPC ..... H01Q 5/35; H01Q 5/378; H01Q 9/0414; H01Q 9/0421; H01Q 9/0428; H01Q 9/045; H01Q 25/001; H01Q 1/243

See application file for complete search history.

(56) References Cited

U.S. PATENT DOCUMENTS

| | | | | |
|---|---|---|---|---|
| 4,827,271 | A * | 5/1989 | Berneking | H01Q 9/0414 343/700 MS |
| 2009/0058731 | A1* | 3/2009 | Geary | H01Q 9/0414 343/700 MS |
| 2015/0194730 | A1 | 7/2015 | Sudo et al. | |
| 2015/0333407 | A1* | 11/2015 | Yamagajo | H01Q 9/0414 343/905 |
| 2016/0013831 | A1 | 1/2016 | Lea et al. | |
| 2016/0261047 | A1* | 9/2016 | Wallace | H01Q 5/335 |

FOREIGN PATENT DOCUMENTS

| | | |
|---|---|---|
| CN | 104662737 A | 5/2015 |

* cited by examiner

*Primary Examiner* — Hoang V Nguyen
(74) *Attorney, Agent, or Firm* — McClure, Qualey & Rodack, LLP

(57) ABSTRACT

An antenna structure includes a ground element, a first radiation element, a second radiation element, a first feeding element, and a second feeding element. The first radiation element is positioned between the second radiation element and the ground element. The first feeding element includes a first coupling excitation element. The second feeding element includes a second coupling excitation element. The first coupling excitation element and the second coupling excitation element are both adjacent to the first radiation element. A first line segment is formed by connecting a central point of the first coupling excitation element to a central axis of the antenna structure. A second line segment is formed by connecting a central point of the second coupling excitation element to the central axis of the antenna structure. An angle between the first line segment and the second line segment is greater than 90 degrees.

20 Claims, 18 Drawing Sheets

300

400

ANTENNA STRUCTURE

CROSS REFERENCE TO RELATED APPLICATIONS

This Application claims priority of Taiwan Patent Application No. 106130794 filed on Sep. 8, 2017, the entirety of which is incorporated by reference herein.

BACKGROUND OF THE INVENTION

Field of the Invention

The disclosure generally relates to an antenna structure, and more particularly, it relates to a coupled-fed wideband antenna structure with dual-polarized characteristics.

Description of the Related Art

With the advancements being made in mobile communication technology, mobile devices such as portable computers, mobile phones, multimedia players, and other hybrid functional portable electronic devices have become more common. To satisfy consumer demand, mobile devices usually implement wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the Internet at high speeds. However, since indoor environments have serious signal reflection and multipath fading, wireless access points should process signals in a variety of polarization directions and from a variety of transmission directions simultaneously. Accordingly, it has become a critical challenge for antenna designers to design a wideband, multi-polarized antenna in the limited space of a wireless access point.

BRIEF SUMMARY OF THE INVENTION

In an exemplary embodiment, the disclosure is directed to an antenna structure including a ground element, a first radiation element, a second radiation element, a first feeding element, and a second feeding element. The first radiation element has a first opening and a second opening. The second radiation element is separated from the first radiation element. The first radiation element is positioned between the second radiation element and the ground element. The first feeding element includes a first coupling excitation element and a first connection element. A first signal source is coupled through the first connection element to the first coupling excitation element. The first connection element passes through the first opening. The first coupling excitation element is adjacent to the first radiation element, and is positioned between the second radiation element and the first radiation element. The second feeding element includes a second coupling excitation element and a second connection element. A second signal source is coupled through the second connection element to the second coupling excitation element. The second connection element passes through the second opening. The second coupling excitation element is adjacent to the first radiation element, and is positioned between the second radiation element and the first radiation element. A first line segment is formed by connecting a central point of the first coupling excitation element to a central axis of the antenna structure. A second line segment is formed by connecting a central point of the second coupling excitation element to the central axis of the antenna structure. An angle between the first line segment and the second line segment is greater than 90 degrees.

In another exemplary embodiment, the disclosure is directed to an antenna structure including a ground element, a first radiation element, a second radiation element, a first feeding element, and a second feeding element. The second radiation element is separated from the first radiation element. The first radiation element is positioned between the second radiation element and the ground element. The first feeding element includes a first coupling excitation element and a first connection element. A first signal source is coupled through the first connection element to the first coupling excitation element. The first coupling excitation element is adjacent to the first radiation element, and is positioned between the first radiation element and the ground element. The second feeding element includes a second coupling excitation element and a second connection element. A second signal source is coupled through the second connection element to the second coupling excitation element. The second coupling excitation element is adjacent to the first radiation element, and is positioned between the first radiation element and the ground element. A first line segment is formed by connecting a central point of the first coupling excitation element to a central axis of the antenna structure. A second line segment is formed by connecting a central point of the second coupling excitation element to the central axis of the antenna structure. An angle between the first line segment and the second line segment is greater than 90 degrees.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
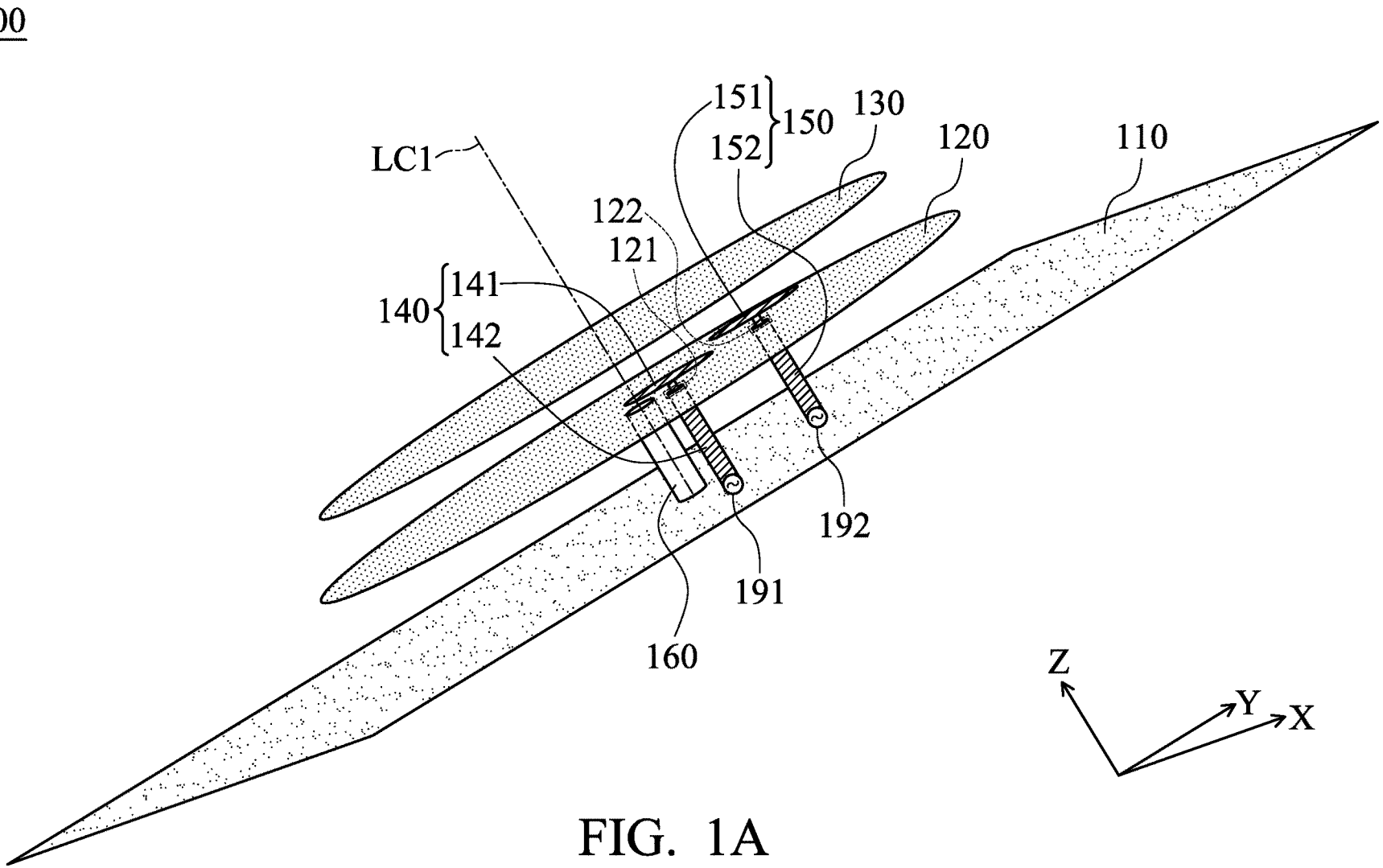
FIG. 1A is a perspective view of an antenna structure according to an embodiment of the invention.
Figure 1B:
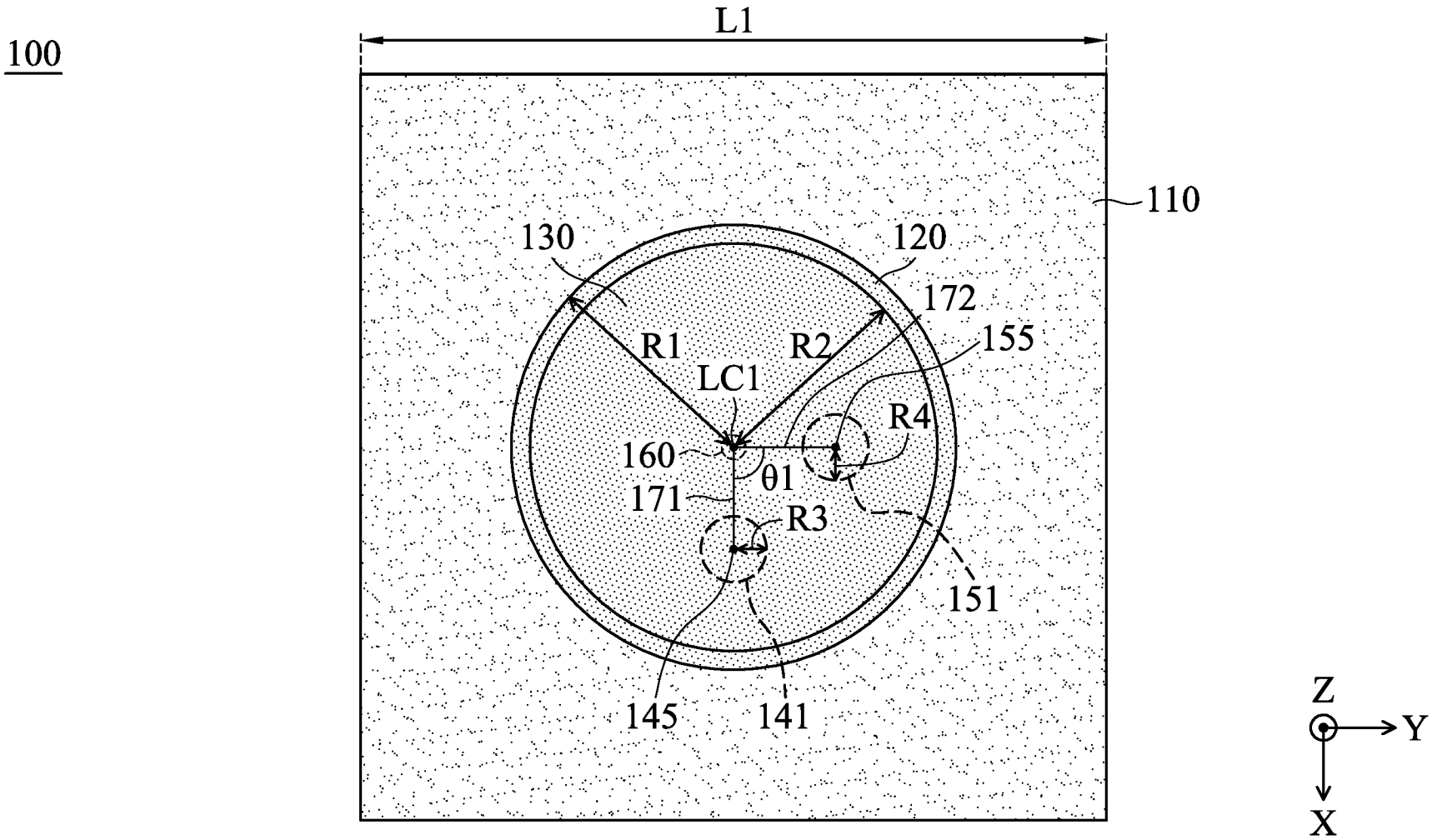
FIG. 1B is a top view of an antenna structure according to an embodiment of the invention.
Figure 1C:
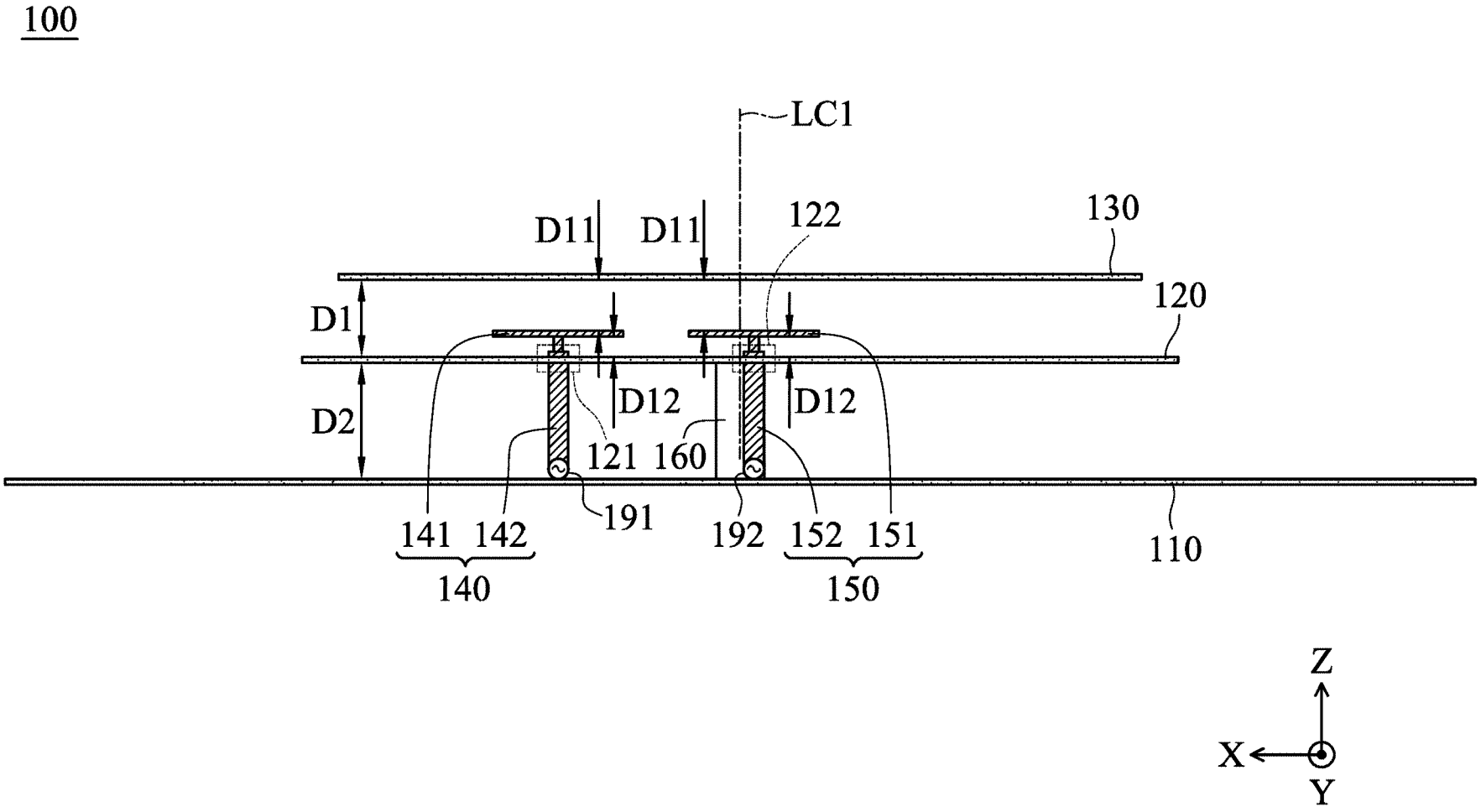
FIG. 1C is a side view of an antenna structure according to an embodiment of the invention.

FIG. 1A is a perspective view of an antenna structure 100 according to an embodiment of the invention. FIG. 1B is a top view of the antenna structure 100 according to an embodiment of the invention. FIG. 1C is a side view of the antenna structure 100 according to an embodiment of the invention. Please refer to FIG. 1A, FIG. 1B, and FIG. 1C together. The antenna structure 100 may be applied in a communication device, such as a wireless access point. In the embodiment of FIG. 1A, FIG. 1B, and FIG. 1C, the antenna structure 100 at least includes a ground element 110, a first radiation element 120, a second radiation element 130, a first feeding element 140, and a second feeding element 150. Each of the ground element 110, the first radiation element 120, the second radiation element 130, the first feeding element 140, and the second feeding element 150 may be made of a metal plate or a metal piece.

The antenna structure 100 has a central axis LC1, which passes through a central point of each of the ground element 110, the first radiation element 120, and the second radiation element 130. For example, the ground element 110 may substantially have a square shape, the first radiation element 120 may substantially have a first circular shape, and the second radiation element 130 may substantially have a second circular shape. The area of the aforementioned second circular shape may be slightly smaller than the area of the aforementioned first circular shape. Specifically, if the first radiation element 120 has a first vertical projection on the ground element 110 and the second radiation element 130 has a second vertical projection on the ground element 110, the whole second vertical projection will be inside the first vertical projection, and a combination of the first vertical projection and the second vertical projection will form concentric circles. It should be noted that the invention is not limited to the above. In alternative embodiments, each of the ground element 110, the first radiation element 120, and the second radiation element 130 will have other symmetrical shapes, such as an equilateral triangle, a diamond shape, an equilateral hexagon, or an equilateral octagon.

The first radiation element 120 has a first opening 121 and a second opening 122. For example, each of the first opening 121 and the second opening 122 may be a circular hole or a square hole, but is not limited thereto. The second radiation element 130 is floating and completely separated from the first radiation element 120. The first radiation element 120 is positioned between the second radiation element 130 and the ground element 110. The second radiation element 130 is semi-permeable in regard with electromagnetic waves, namely, the second radiation element 130 is configured to be partially reflecting and partially permeating the electromagnetic waves from the first radiation element 120, thereby improving the gain and the bandwidth of the antenna structure 100.

The first feeding element 140 includes a first coupling excitation element 141 and a first connection element 142. A first signal source 191 is coupled through the first connection element 142 to the first coupling excitation element 141. Specifically, the first connection element 142 passes through the first opening 121 of the first radiation element 120. The first coupling excitation element 141 is adjacent to but separated from the first radiation element 120. The first coupling excitation element 141 is positioned between the second radiation element 130 and the first radiation element 120. The second feeding element 150 includes a second coupling excitation element 151 and a second connection element 152. A second signal source 192 is coupled through the second connection element 152 to the second coupling excitation element 151. Specifically, the second connection element 152 passes through the second opening 122 of the first radiation element 120. The second coupling excitation element 151 is adjacent to but separated from the first radiation element 120. The second coupling excitation element 151 is positioned between the second radiation element 130 and the first radiation element 120. It should be noted that the term "adjacent" or "close" over the disclosure means that the distance (spacing) between two corresponding elements is smaller than a predetermined distance (e.g., 2 mm or the shorter) without physical contacts.

The first coupling excitation element 141 and the second coupling excitation element 151 may be positioned on the same specific plane. For example, the ground element 110, the first radiation element 120, the third radiation element 130, and the aforementioned specific plane may be parallel to each other. The first coupling excitation element 141 may substantially have a third circular shape, and the second coupling excitation element 151 may substantially have a fourth circular shape. The area of the aforementioned fourth circular shape may be substantially equal to the area of the aforementioned third circular shape. It should be noted that the invention is not limited to the above. In alternative embodiments, each of the first coupling excitation element 141 and the second coupling excitation element 151 may have other symmetrical shapes, such as an equilateral triangle, a diamond shape, an equilateral hexagon, or an equilateral octagon. The first connection element 142 may be a first coaxial cable. A central conductive wire of the first coaxial cable may be coupled to the first coupling excitation element 141. A conductive sheath of the first coaxial cable may be coupled to the ground element 110 without physical contact with the first radiation element 120. The second connection element 152 may be a second coaxial cable. A central conductive wire of the second coaxial cable may be coupled to the second coupling excitation element 151. A conductive sheath of the second coaxial cable may be coupled to the ground element 110, without physical contact with the first radiation element 120. The first signal source 191 and the second signal source 192 may be configured to generate feeding signals with the same operation frequency in order to excite the antenna structure 100 and to achieve the dual-polarized characteristics.

In some embodiments, the antenna structure 100 further includes a supporting pillar 160. The supporting pillar 160 is connected to the ground element 110, and is configured to support the first radiation element 120. For example, the supporting pillar 160 may be made of a metal material or a non-metal material, and the supporting pillar 160 may be aligned with the central axis LC1 of the antenna structure 100. It should be understood that the supporting pillar 160 is an optional element, and the supporting pillar 160 is removable in other embodiments.

With respect to antenna theory, the dual-coupled-fed and dual-polarized antenna structure 100 is formed by using both the first feeding element 140 and the second feeding element 150. It should be noted that the bandwidth of the antenna structure 100 is significantly increased since a respective effective feeding capacitor is formed between the first radiation element 120 and each of the first coupling excitation element 141 and the second coupling excitation element 151. In addition, such a dual-feed mechanism can improve the XPI (Cross-Polarization Isolation) of the antenna structure 100. Furthermore, a first line segment 171 is formed by connecting a central point 145 of the first coupling excitation element 141 to the central axis LC1 of the antenna structure 100 (the first line segment 171 is perpendicular to the central axis LC1), and a second line segment 172 is formed by connecting a central point 155 of the second coupling excitation element 151 to the central axis LC1 of the antenna structure 100 (the second line segment 172 is perpendicular to the central axis LC1). The length of the first line segment 171 and the length of the second line segment 172 are equal. The angle θ1 between the first line segment 171 and the second line segment 172 is greater than 90 degrees. The above angle range can further fine-tune the impedance matching of the antenna structure 100. Please refer to the following embodiments of FIG. 1D and FIG. 1E to understand it. It should be noted that the first line segment 171 and the second line segment 172 are virtual line segments for helping to define the angle and the length between two points, and they are not physical elements.

Figure 1D:
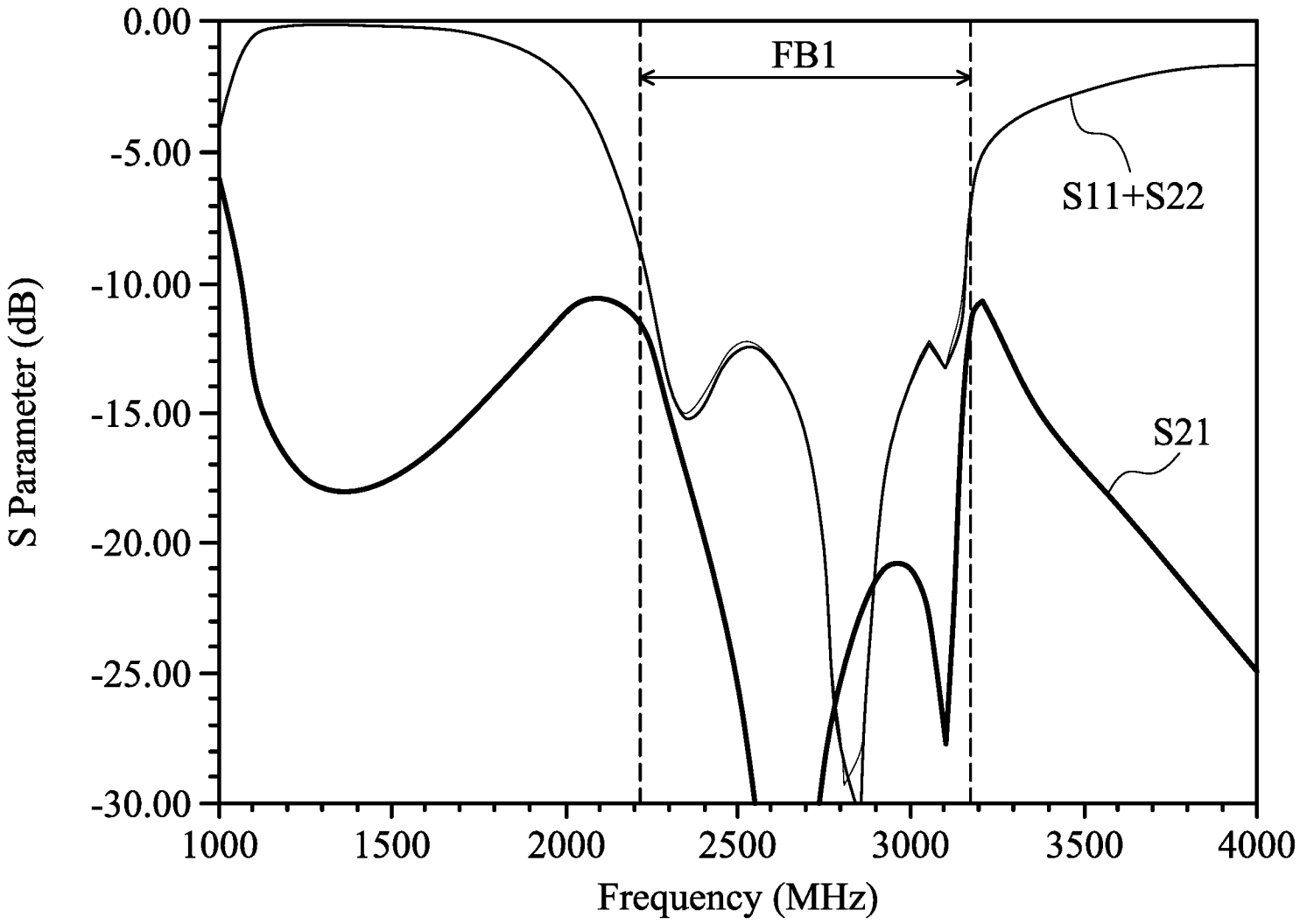
FIG. 1D is a diagram of S parameters of an antenna structure according to an embodiment of the invention.

FIG. 1D is a diagram of S parameters of the antenna structure 100 according to an embodiment of the invention. The horizontal axis represents the operation frequency (MHz), and the vertical axis represents the S parameters (dB). The first signal source 191 is set as a first port (Port 1), and the second signal source 192 is set as a second port (Port 2). In the embodiment of FIG. 1D, the angle θ1 between the first line segment 171 and the second line segment 172 is exactly 98 degrees (i.e., greater than 90 degrees). According to the S11 and S22 parameters of FIG. 1D, when the antenna structure 100 is fed by both the first signal source 191 and the second signal source 192, the antenna structure 100 is capable of covering an operation frequency band FB1 from 2234 MHz to 3150 MHz, and the bandwidth of the antenna structure 100 is about 34%. Therefore, the antenna structure 100 can support at least the wideband operations of LTE (Long Term Evolution) Band 40/Band 41. Furthermore, according to the S21 (or S12) parameter of FIG. 1D, at a central operation frequency (e.g., 2692 MHz) of the operation frequency band FB1, the isolation between the first signal source 191 and the second signal source 192 (i.e., the absolute value of the S21 parameter) is 30 dB or higher, and it can meet the requirements of practical application of general mobile communication devices.

Figure 1E:
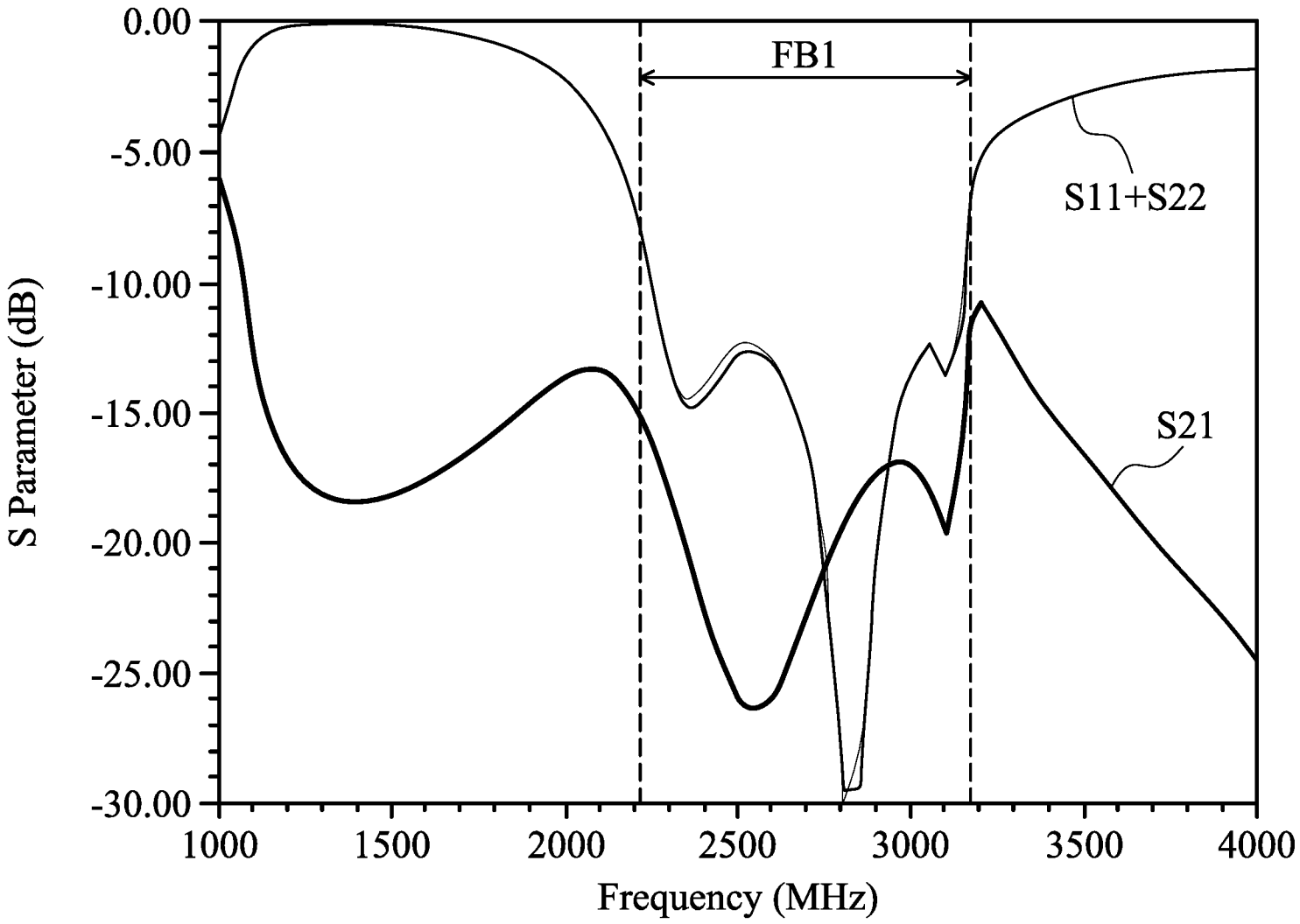
FIG. 1E is a diagram of S parameters of an antenna structure with a 90-degree angle between a first line segment and a second line segment.

FIG. 1E is a diagram of S parameters of the antenna structure 100 with a 90-degree angle θ1 between the first line segment 171 and the second line segment 172. According to the S21 (or S12) parameter of FIG. 1E, if the angle θ1 between the first line segment 171 and the second line segment 172 is reduced to 90 degrees (i.e., it is not greater than 90 degrees), the best isolation point between the first signal source 191 and the second signal source 192 will move toward the relatively low frequency, and the best isolation point will not overlap the central operation frequency of the operation frequency band FB1. Specifically, at the central operation frequency of the operation frequency band FB1, the isolation between the first signal source 191 and the second signal source 192 is reduced to 23 dB. By comparing FIG. 1D with FIG. 1E, it can be understood that the isolation characteristics of the antenna structure 100 are significantly improved when the angle θ1 between the first line segment 171 and the second line segment 172 is set so that it is greater than 90 degrees.

In some embodiments, the element sizes of the antenna structure 100 are as follows: The length L1 of each side of the square shape of the ground element 110 is substantially from 1.3 to 1.4 wavelength (1.3λ~1.4λ) of the central operation frequency of the antenna structure 100, such as 1.35 wavelength (1.35λ). The radius R1 of the first circular shape of the first radiation element 120 is greater than or equal to 0.25 wavelength (0.25λ) of the central operation frequency of the antenna structure 100. The radius R2 of the second circular shape of the second radiation element 130 is smaller than or equal to 0.25 wavelength (0.25λ) of the central operation frequency of the antenna structure 100. The radius R3 of the third circular shape of the first coupling excitation element 141 is substantially from 0.01 to 0.05 wavelength (0.01λ~0.05λ) of the central operation frequency of the antenna structure 100. The radius R4 of the fourth circular shape of the second coupling excitation element 151 is substantially from 0.01 to 0.05 wavelength (0.01λ~0.05λ) of the central operation frequency of the antenna structure 100. The length of each of the first line segment 171 and the second line segment 172 is smaller than or equal to 0.125 wavelength (0.125λ) of the central operation frequency of the antenna structure 100. The distance D1 between the second radiation element 130 and the first radiation element 120 is substantially from 0.003 to 0.1 wavelength (0.003λ~0.1λ) of the central operation frequency of the antenna structure 100. The distance D2 between the first radiation element 120 and the ground element 110 is substantially from 0.003 to 0.1 wavelength (0.003λ~0.1λ) of the central operation frequency of the antenna structure 100. A distance D11 is defined between the first coupling excitation element 141 (or the second coupling excitation element 151) and the second radiation element 130. A distance D12 is defined between the first coupling excitation element 141 (or the second coupling excitation element 151) and the first radiation element 120. The ratio (D11/D12) of the distance D11 to the distance D12 is substantially from 2 to 3, such as 2.56. The above ranges of element sizes are calculated and obtained according to many experiment results, and they help to optimize the operation frequency band, the isolation, and the impedance matching of the antenna structure 100.

Figure 2A:
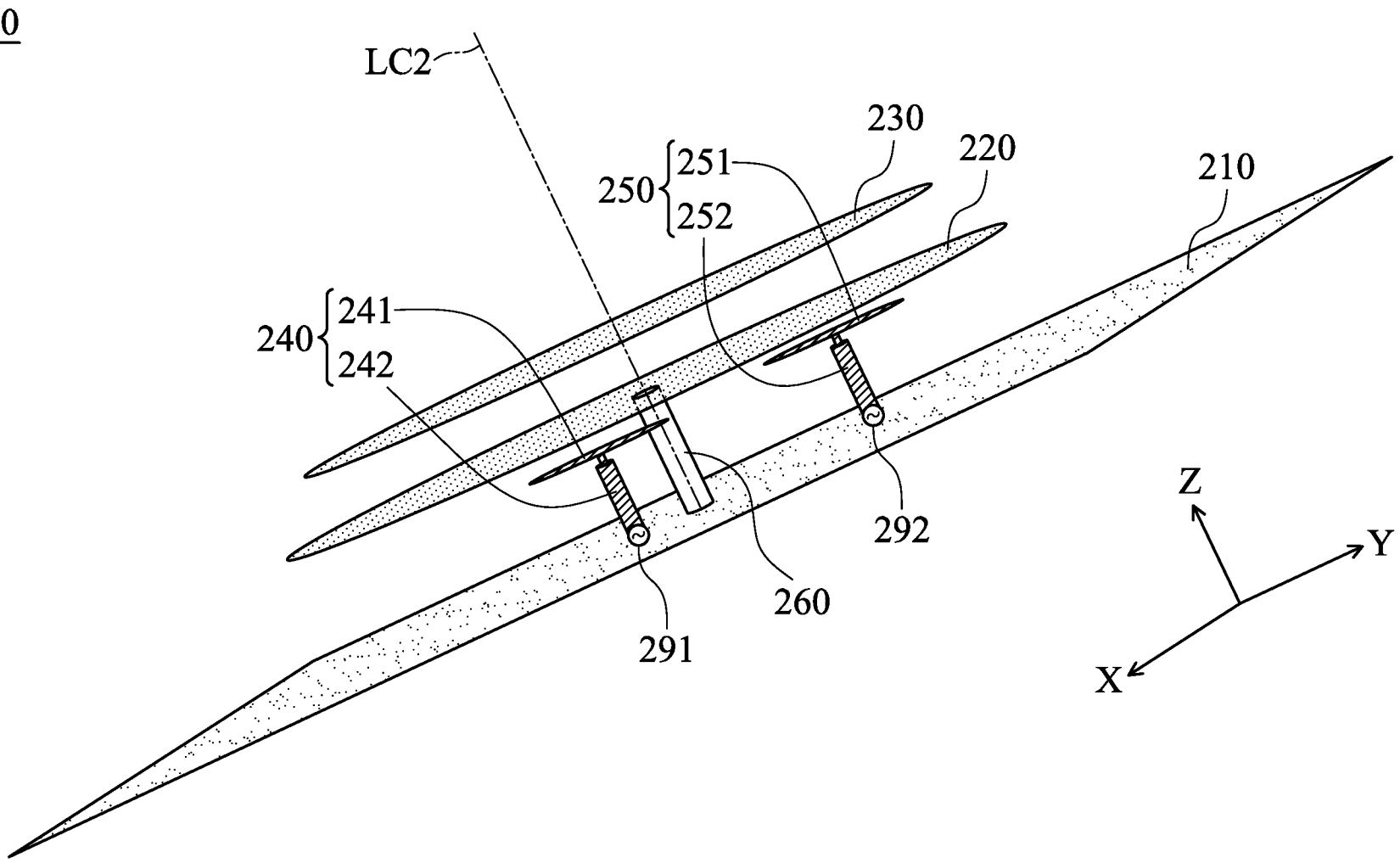
FIG. 2A is a perspective view of an antenna structure according to an embodiment of the invention.
Figure 2B:
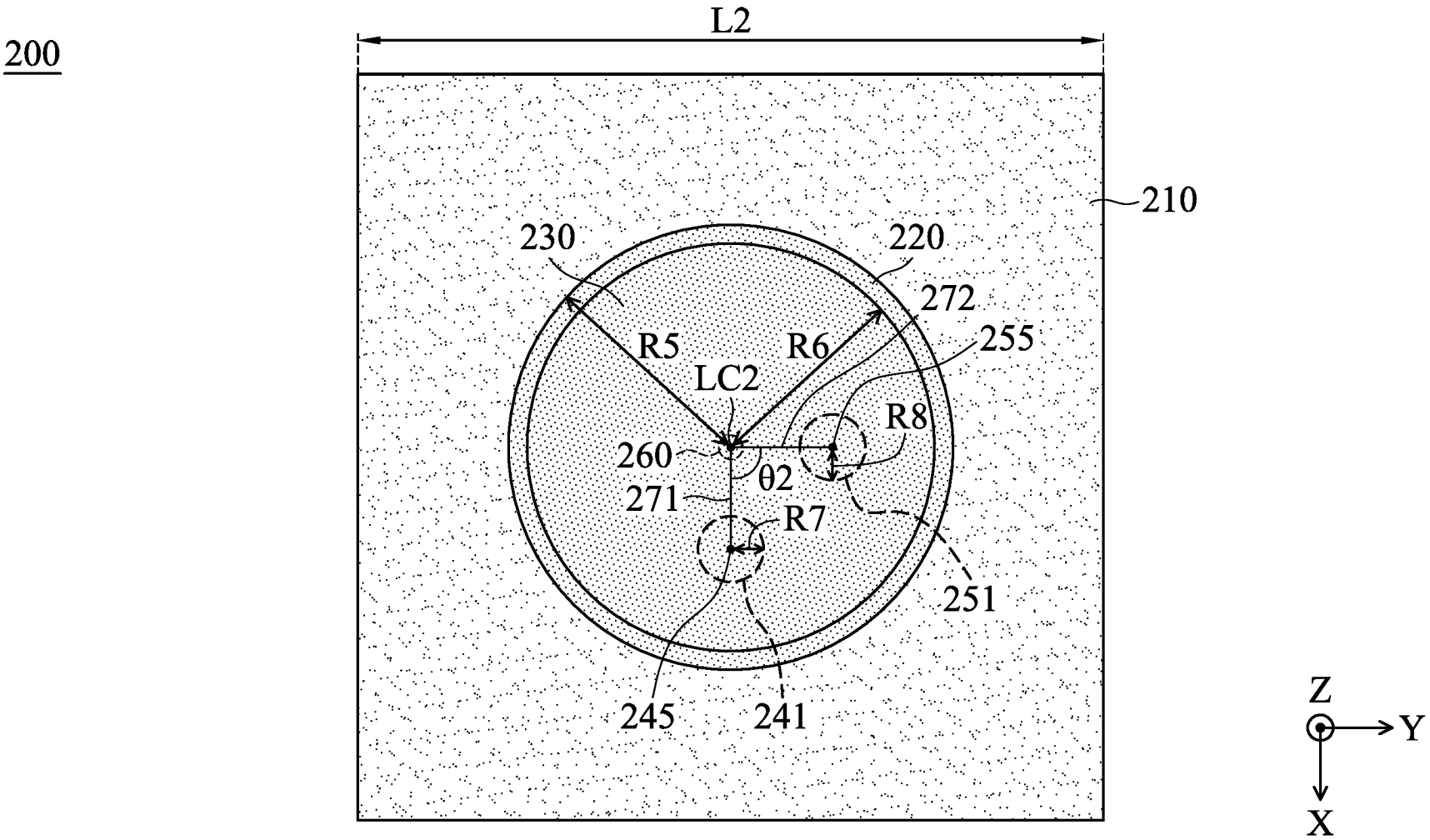
FIG. 2B is a top view of an antenna structure according to an embodiment of the invention.
Figure 2C:
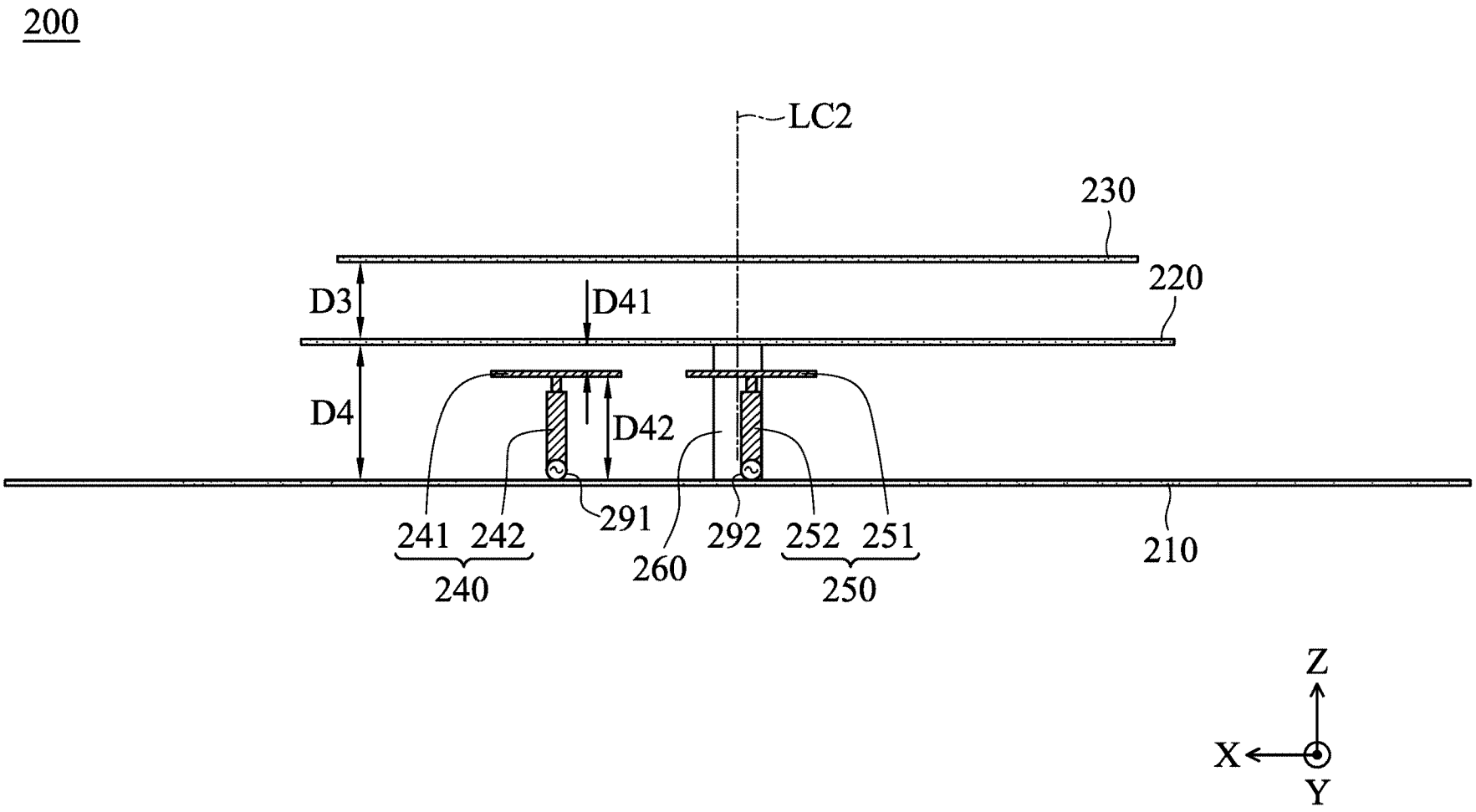
FIG. 2C is a side view of an antenna structure according to an embodiment of the invention.

FIG. 2A is a perspective view of an antenna structure 200 according to an embodiment of the invention. FIG. 2B is a top view of the antenna structure 200 according to an embodiment of the invention. FIG. 2C is a side view of the antenna structure 200 according to an embodiment of the invention. Please refer to FIG. 2A, FIG. 2B, and FIG. 2C together. The antenna structure 200 may be applied to a communication device, such as a wireless access point. In the embodiment of FIG. 2A, FIG. 2B, and FIG. 2C, the antenna structure 200 at least includes a ground element 210, a first radiation element 220, a second radiation element 230, a first feeding element 240, and a second feeding element 250. Each of the ground element 210, the first radiation element 220, the second radiation element 230, the first feeding element 240, and the second feeding element 250 may be made of a metal plate or a metal piece.

The antenna structure 200 has a central axis LC2, which passes through a central point of each of the ground element 210, the first radiation element 220, and the second radiation element 230. For example, the ground element 210 may substantially have a square shape, the first radiation element 220 may substantially have a first circular shape, and the second radiation element 230 may substantially have a second circular shape. The area of the aforementioned second circular shape may be slightly smaller than the area of the aforementioned first circular shape. Specifically, if the first radiation element 220 has a first vertical projection on the ground element 210 and the second radiation element 230 has a second vertical projection on the ground element 210, the whole second vertical projection will be inside the first vertical projection, and a combination of the first vertical projection and the second vertical projection will form concentric circles. It should be noted that the invention is not limited to the above. In alternative embodiments, each of the ground element 210, the first radiation element 220, and the second radiation element 230 may have other symmetrical shapes, such as an equilateral triangle, a diamond shape, an equilateral hexagon, or an equilateral octagon.

The first radiation element 220 does not have any openings specifically for any conductive wires or other conductive materials to pass through. The second radiation element 230 is floating and completely separated from the first radiation element 220. The first radiation element 220 is positioned between the second radiation element 230 and the ground element 210. The second radiation element 230 is semi-permeable in regard with electromagnetic waves, namely, the second radiation element 130 is configured to be partially reflecting and partially permeating the electromagnetic waves from the first radiation element 220, thereby improving the gain and the bandwidth of the antenna structure 200.

The first feeding element 240 includes a first coupling excitation element 241 and a first connection element 242. A first signal source 291 is coupled through the first connection element 242 to the first coupling excitation element 241. Specifically, the first coupling excitation element 241 is adjacent to the first radiation element 220, but it is separated from the first radiation element 220. The first coupling excitation element 241 is positioned between the first radiation element 220 and the ground element 210. The second feeding element 250 includes a second coupling excitation element 251 and a second connection element 252. A second signal source 292 is coupled through the second connection element 252 to the second coupling excitation element 251. Specifically, the second coupling excitation element 251 is adjacent to but separated from the first radiation element 220. The second coupling excitation element 251 is positioned between the first radiation element 220 and the ground element 210.

The first coupling excitation element 241 and the second coupling excitation element 251 may be positioned on the same plane. For example, the ground element 210, the first radiation element 220, the third radiation element 230, the first coupling excitation element 241, and the second coupling excitation element 251 may be parallel to each other. The first coupling excitation element 241 may substantially have a third circular shape, and the second coupling excitation element 251 may substantially have a fourth circular shape. The area of the aforementioned fourth circular shape may be substantially equal to the area of the aforementioned third circular shape. It should be noted that the invention is not limited to the above. In alternative embodiments, each of the first coupling excitation element 241 and the second coupling excitation element 251 may have other symmetrical shapes, such as an equilateral triangle, a diamond shape, an equilateral hexagon, or an equilateral octagon. The first connection element 242 may be a first coaxial cable. A central conductive wire of the first coaxial cable may be coupled to the first coupling excitation element 241. A conductive sheath of the first coaxial cable may be coupled to the ground element 210. The second connection element 252 may be a second coaxial cable. A central conductive wire of the second coaxial cable may be coupled to the second coupling excitation element 251. A conductive sheath of the second coaxial cable may be coupled to the ground element 210. The first signal source 291 and the second signal source 292 are configured to generate feeding signals with the same operation frequency. Therefore, the antenna structure 200 is excited to achieve the dual-polarized characteristics.

In some embodiments, the antenna structure 200 further includes a supporting pillar 260. The supporting pillar 260 is connected to the ground element 210, and is configured to support the first radiation element 220. For example, the supporting pillar 260 may be made of a metal material or a non-metal material, and the supporting pillar 260 may be aligned with the central axis LC2 of the antenna structure 200. It should be understood that the supporting pillar 260 is an optional element, and the supporting pillar 260 is removable in other embodiments.

With respect to antenna theory, the dual-coupled-fed and dual-polarized antenna structure 200 is formed by using both the first feeding element 240 and the second feeding element 250. It should be noted that the bandwidth of the antenna structure 200 is significantly increased since a respective effective feeding capacitor is formed between the first radiation element 220 and each of the first coupling excitation element 241 and the second coupling excitation element 251. In addition, such a dual-feed mechanism can improve the XPI (Cross-Polarization Isolation) of the antenna structure 200. Furthermore, a first line segment 271 is formed by connecting a central point 245 of the first coupling excitation element 241 to the central axis LC2 of the antenna structure 200 (the first line segment 271 is perpendicular to the central axis LC2), and a second line segment 272 is formed by connecting a central point 255 of the second coupling excitation element 251 to the central axis LC2 of the antenna structure 200 (the second line segment 272 is perpendicular to the central axis LC2). The length of the first line segment 271 and the length of the second line segment 272 are equal. The angle θ2 between the first line segment 271 and the second line segment 272 is greater than 90 degrees. The above angle range can further fine-tune the impedance matching of the antenna structure 200. Please refer to the following embodiments of FIG. 2D and FIG. 2E to understand it.

Figure 2D:
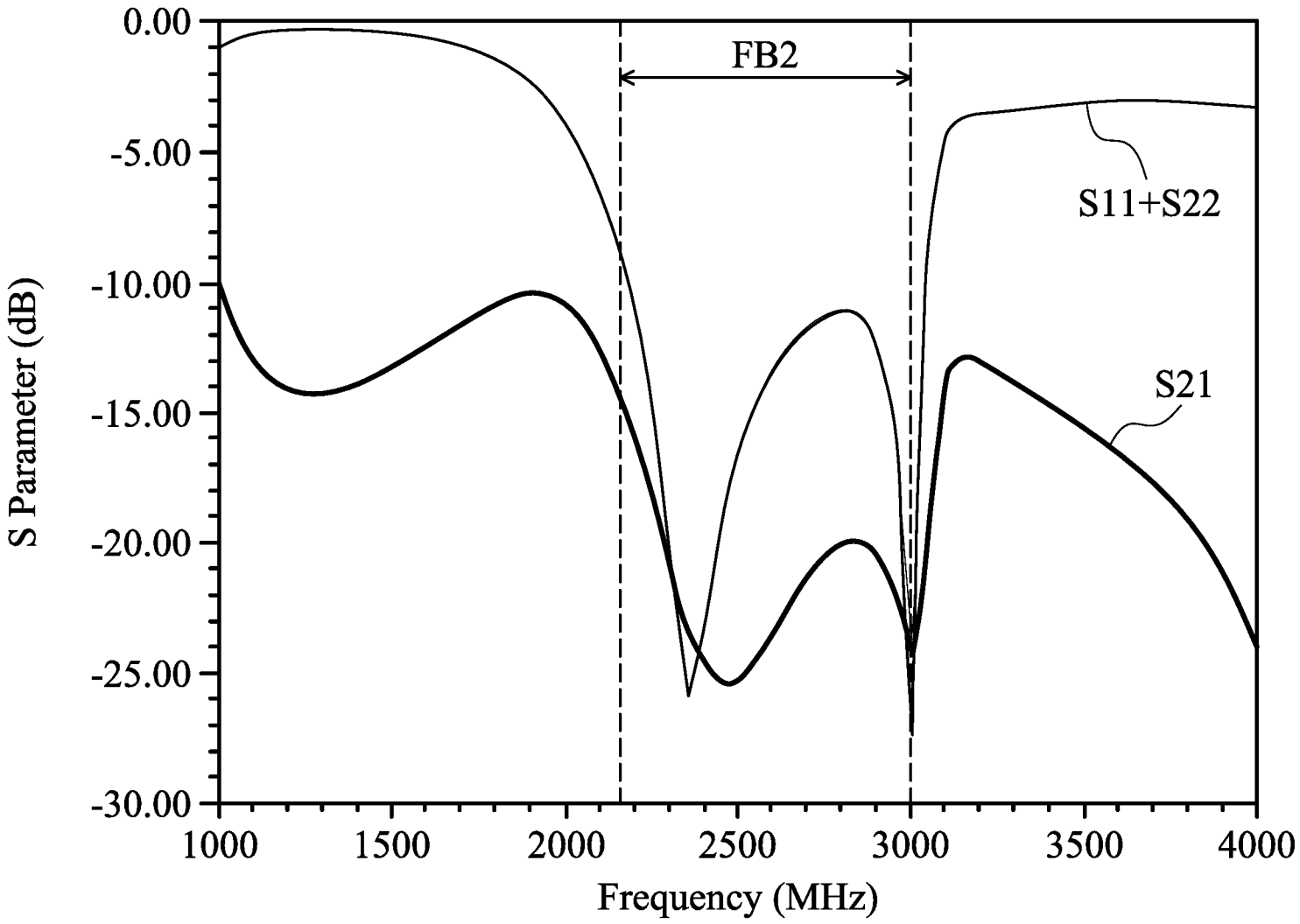
FIG. 2D is a diagram of S parameters of an antenna structure according to an embodiment of the invention.

FIG. 2D is a diagram of S parameters of the antenna structure 200 according to an embodiment of the invention. The horizontal axis represents the operation frequency (MHz), and the vertical axis represents the S parameters (dB). The first signal source 291 is set as a first port (Port 1), and the second signal source 292 is set as a second port (Port 2). In the embodiment of FIG. 2D, the angle θ2 between the first line segment 271 and the second line segment 272 is exactly 94 degrees (i.e., it is greater than 90 degrees). According to the S11 and S22 parameters of FIG. 2D, when the antenna structure 200 is fed by both the first signal source 291 and the second signal source 292, the antenna structure 200 will be capable of covering an operation frequency band FB2 from 2175 MHz to 3034 MHz, and the bandwidth of the antenna structure 200 is about 33%. Therefore, the antenna structure 200 can support at least the wideband operations of LTE Band 40/Band 41. Furthermore, according to the S21 (or S12) parameter of FIG. 2D, at a central operation frequency (e.g., 2604.5 MHz) of the operation frequency band FB2, the isolation between the first signal source 291 and the second signal source 292 is 24 dB or higher, and it can meet the requirements of practical application of general mobile communication devices.

Figure 2E:
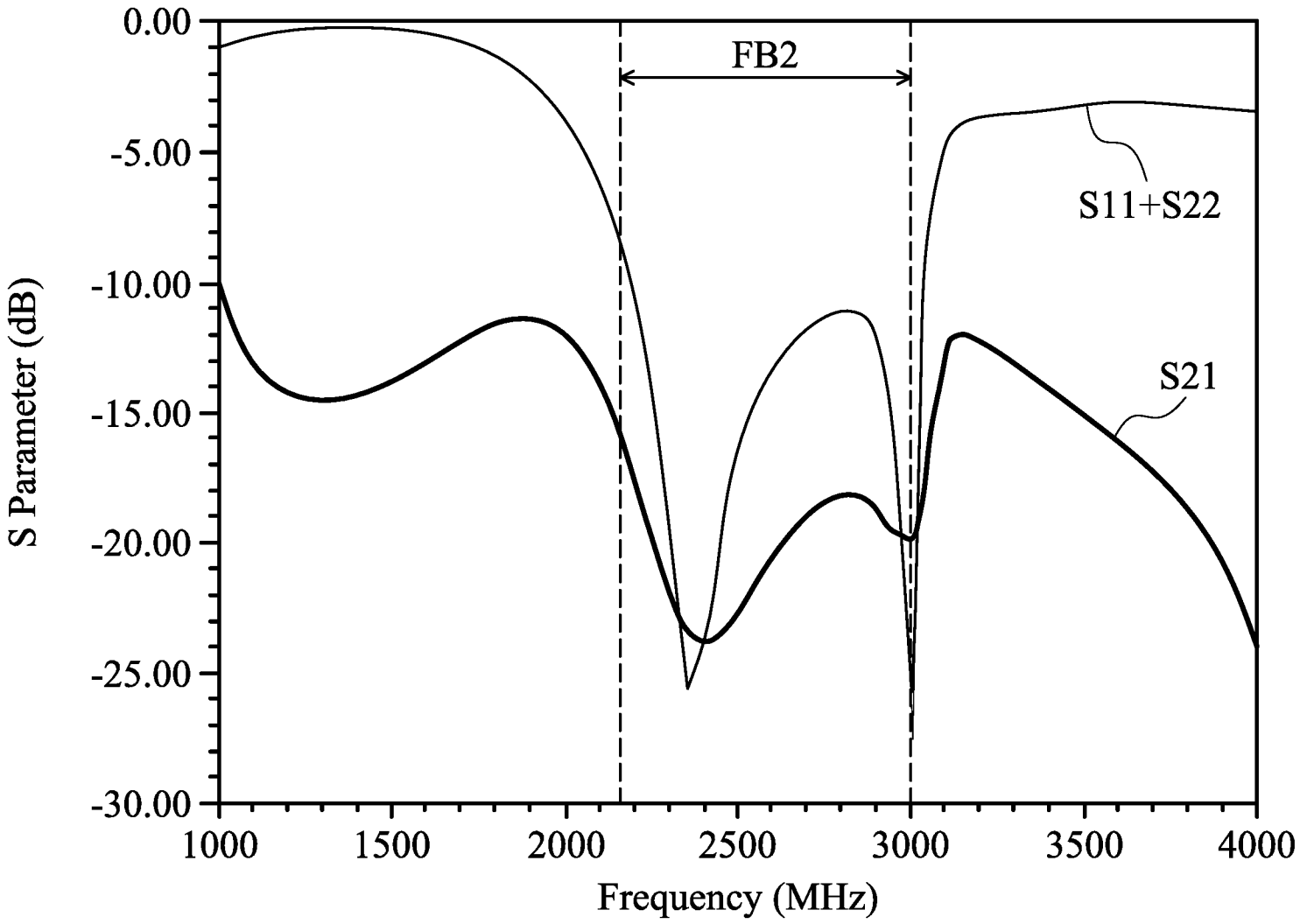
FIG. 2E is a diagram of S parameters of an antenna structure with a 90-degree angle between a first line segment and a second line segment.

FIG. 2E is a diagram of S parameters of the antenna structure 200 with a 90-degree angle θ2 between the first line segment 271 and the second line segment 272. According to the S21 (or S12) parameter of FIG. 2E, if the angle θ2 between the first line segment 271 and the second line segment 272 is reduced to 90 degrees (i.e., not greater than 90 degrees), the best isolation point between the first signal source 291 and the second signal source 292 will move toward the relatively low frequency, and the best isolation point will not overlap the central operation frequency of the operation frequency band FB2. Specifically, at the central operation frequency of the operation frequency band FB2, the isolation between the first signal source 291 and the second signal source 292 is reduced to 20 dB. By comparing FIG. 2D with FIG. 2E, it can be understood that the isolation characteristics of the antenna structure 200 are significantly improved when the angle θ2 between the first line segment 271 and the second line segment 272 is set so that it is greater than 90 degrees.

In some embodiments, the element sizes of the antenna structure 200 are as follows: The length L2 of each side of the square shape of the ground element 210 is substantially from 1.2 to 1.4 wavelength (1.2λ~1.4λ) of the central operation frequency of the antenna structure 200, such as 1.3 wavelength (1.3λ). The radius R5 of the first circular shape of the first radiation element 220 is greater than or equal to 0.25 wavelength (0.25λ) of the central operation frequency of the antenna structure 200. The radius R6 of the second circular shape of the second radiation element 230 is smaller than or equal to 0.25 wavelength (0.25λ) of the central operation frequency of the antenna structure 200. The radius R7 of the third circular shape of the first coupling excitation element 241 is substantially from 0.01 to 0.05 wavelength (0.01λ~0.05λ) of the central operation frequency of the antenna structure 200. The radius R8 of the fourth circular shape of the second coupling excitation element 251 is substantially from 0.01 to 0.05 wavelength (0.01λ~0.05λ) of the central operation frequency of the antenna structure 200. The length of each of the first line segment 271 and the second line segment 272 is smaller than or equal to 0.125 wavelength (0.125λ) of the central operation frequency of the antenna structure 200. The distance D3 between the second radiation element 230 and the first radiation element 220 is substantially from 0.003 to 0.1 wavelength (0.003λ~0.1λ) of the central operation frequency of the antenna structure 200. The distance D4 between the first radiation element 220 and the ground element 210 is substantially from 0.003 to 0.1 wavelength (0.003λ~0.1λ) of the central operation frequency of the antenna structure 200. A distance D42 is defined between the first coupling excitation element 241 (or the second coupling excitation element 251) and the ground element 210. A distance D41 is defined between the first coupling excitation element 241 (or the second coupling excitation element 251) and the first radiation element 220. The ratio (D42/D41) of the distance D42 to the distance D41 is substantially from 4 to 5, such as 4.19. The above ranges of element sizes are calculated and obtained according to many experiment results, and they help to optimize the operation frequency band, the isolation, and the impedance matching of the antenna structure 200.

Figure 3A:
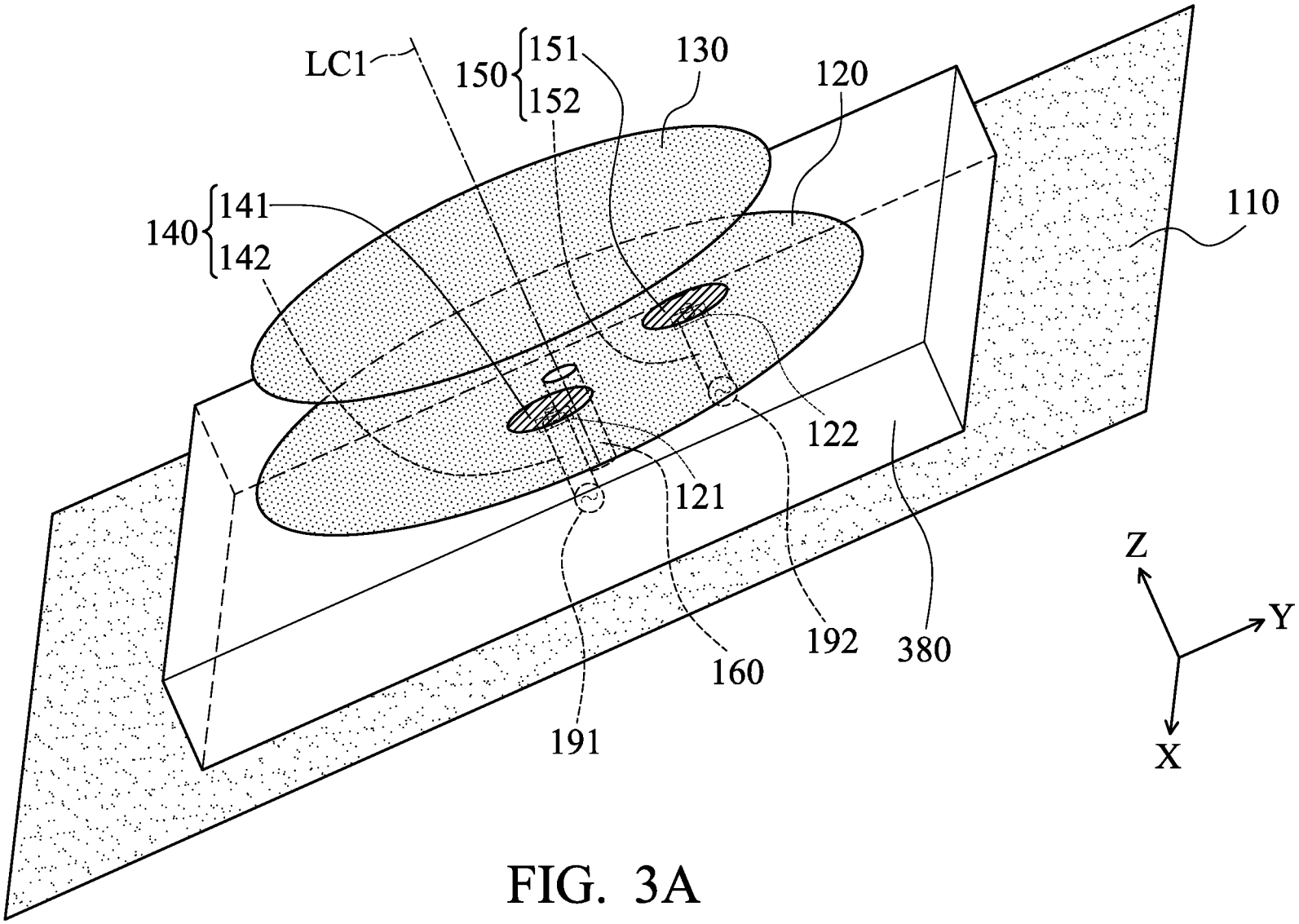
FIG. 3A is a perspective view of an antenna structure according to another embodiment of the invention.
Figure 3B:
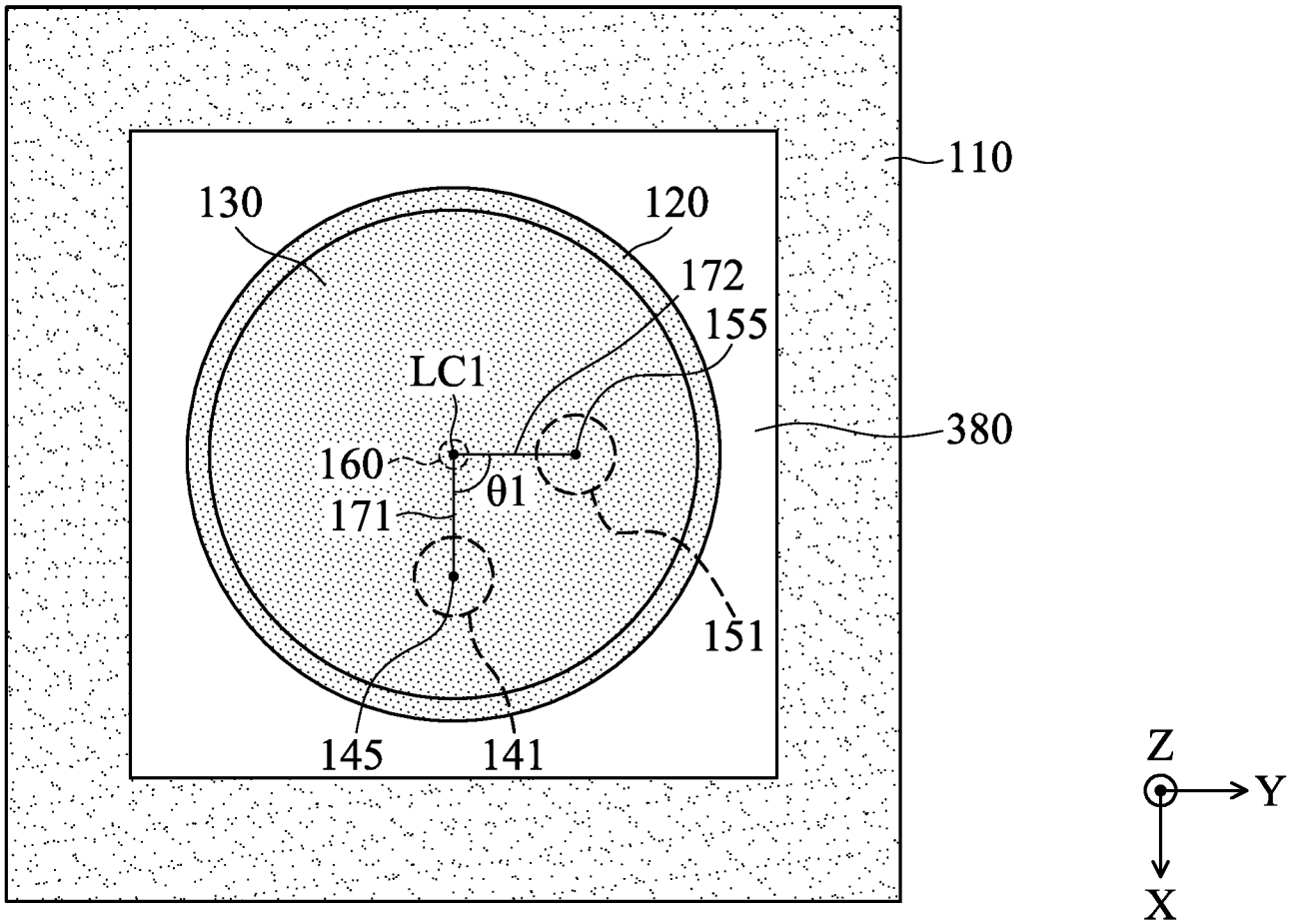
FIG. 3B is a top view of an antenna structure according to another embodiment of the invention.
Figure 3C:
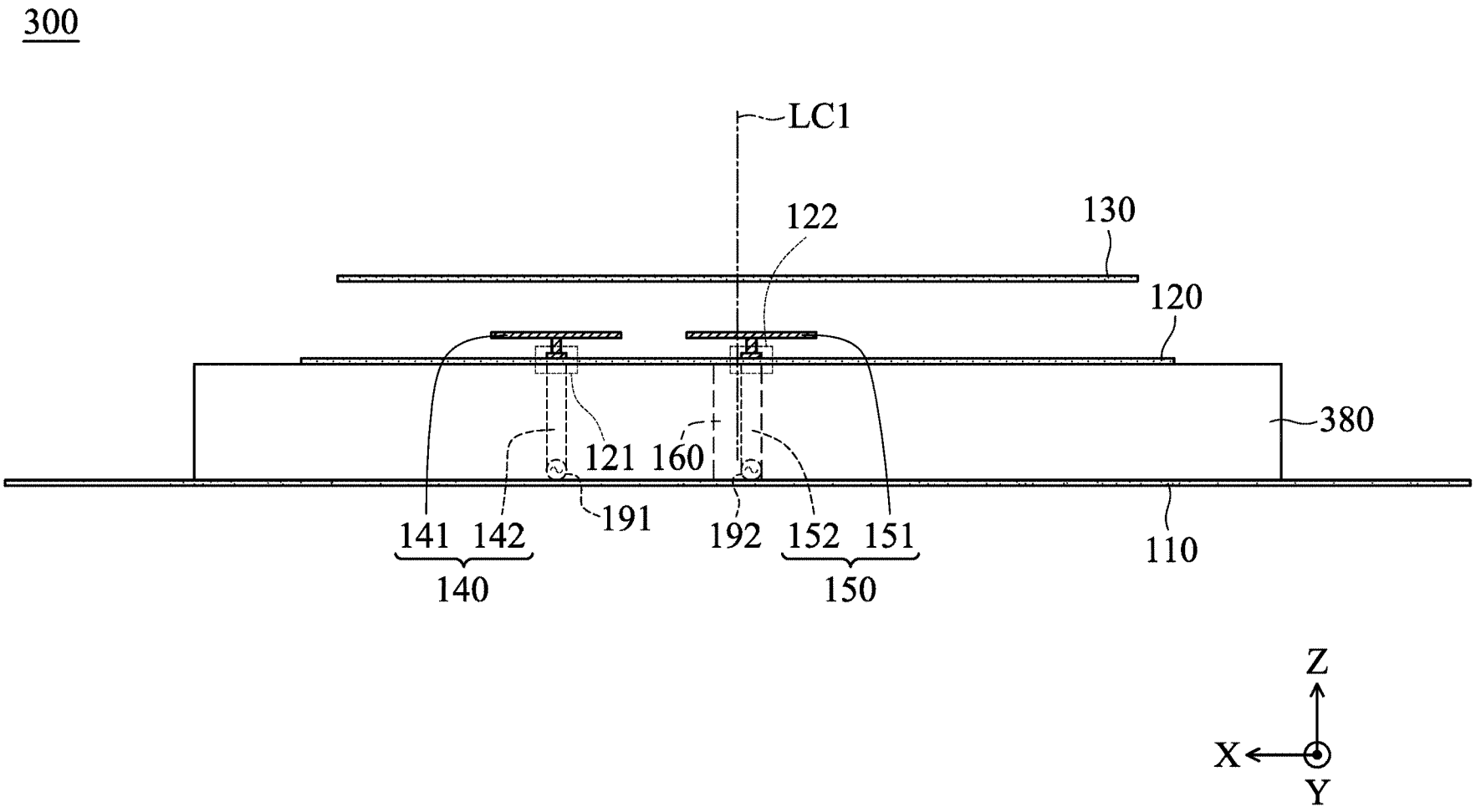
FIG. 3C is a side view of an antenna structure according to another embodiment of the invention.
Figure 3D:
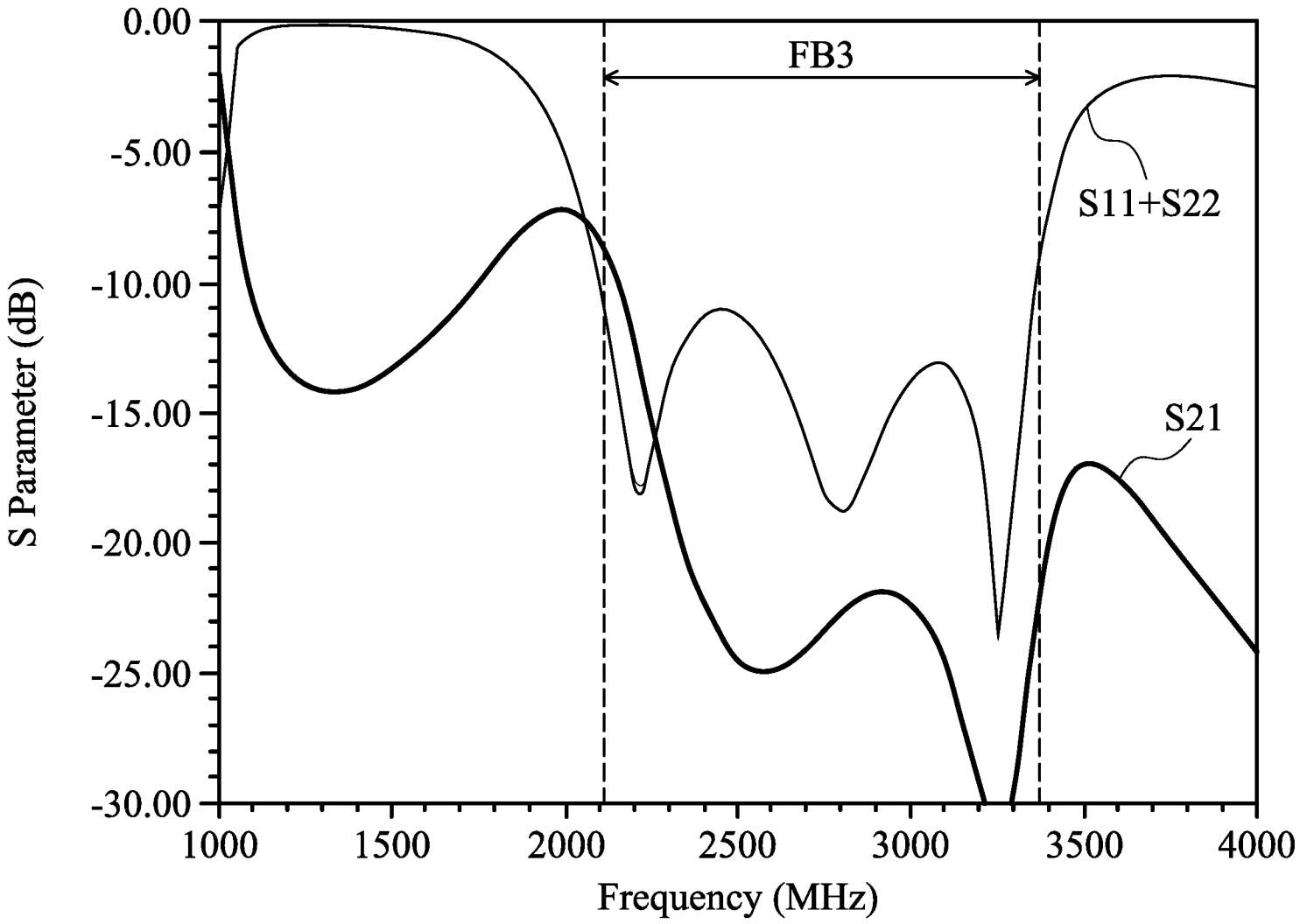
FIG. 3D is a diagram of S parameters of an antenna structure according to another embodiment of the invention.

FIG. 3A is a perspective view of an antenna structure 300 according to another embodiment of the invention. FIG. 3B is a top view of the antenna structure 300 according to another embodiment of the invention. FIG. 3C is a side view of the antenna structure 300 according to another embodiment of the invention. Please refer to FIG. 3A, FIG. 3B, and FIG. 3C together. FIG. 3A, FIG. 3B, and FIG. 3C are similar to FIG. 1A, FIG. 1B, and FIG. 1C. The difference between them is that the antenna structure 300 further includes a dielectric substrate 380 disposed between the first radiation element 120 and the ground element 110. FIG. 3D is a diagram of S parameters of the antenna structure 300 according to another embodiment of the invention. According to the S11 and S22 parameters of FIG. 3D, when the antenna structure 300 is fed by both the first signal source 191 and the second signal source 192, the antenna structure 300 is capable of covering an operation frequency band FB3 from 2100 MHz to 3350 MHz, and the bandwidth of the antenna structure 300 is about 45.9%. Therefore, the incorporation of the dielectric substrate 380 further broadens the operation frequency range of the antenna structure 300. Other features of the antenna structure 300 of FIG. 3A, FIG. 3B, and FIG. 3C are similar to those of the antenna structure 100 of FIG. 1A, FIG. 1B, and FIG. 1C. Accordingly, the two embodiments can achieve similar levels of performance.

Figure 4A:
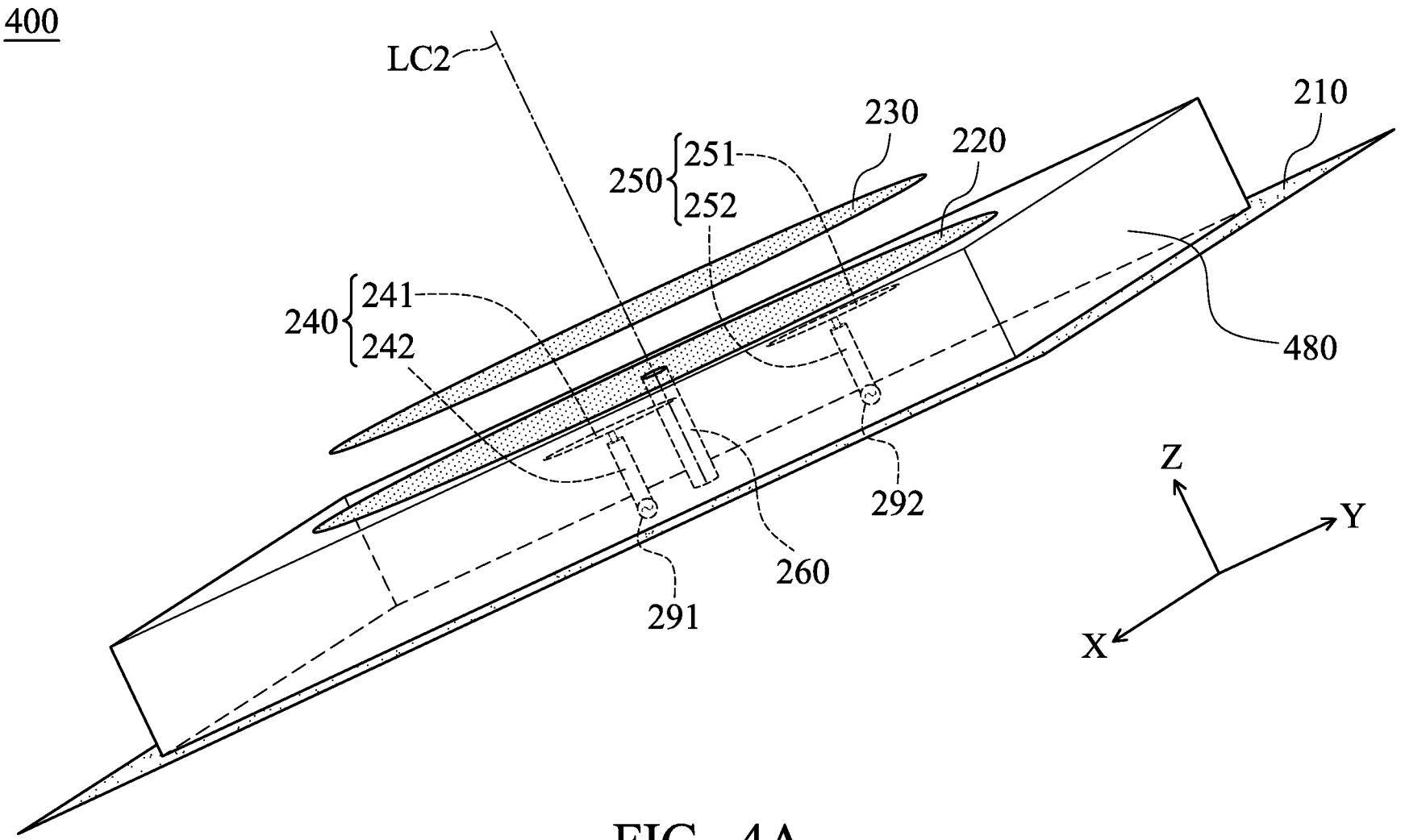
FIG. 4A is a perspective view of an antenna structure according to another embodiment of the invention.
Figure 4B:
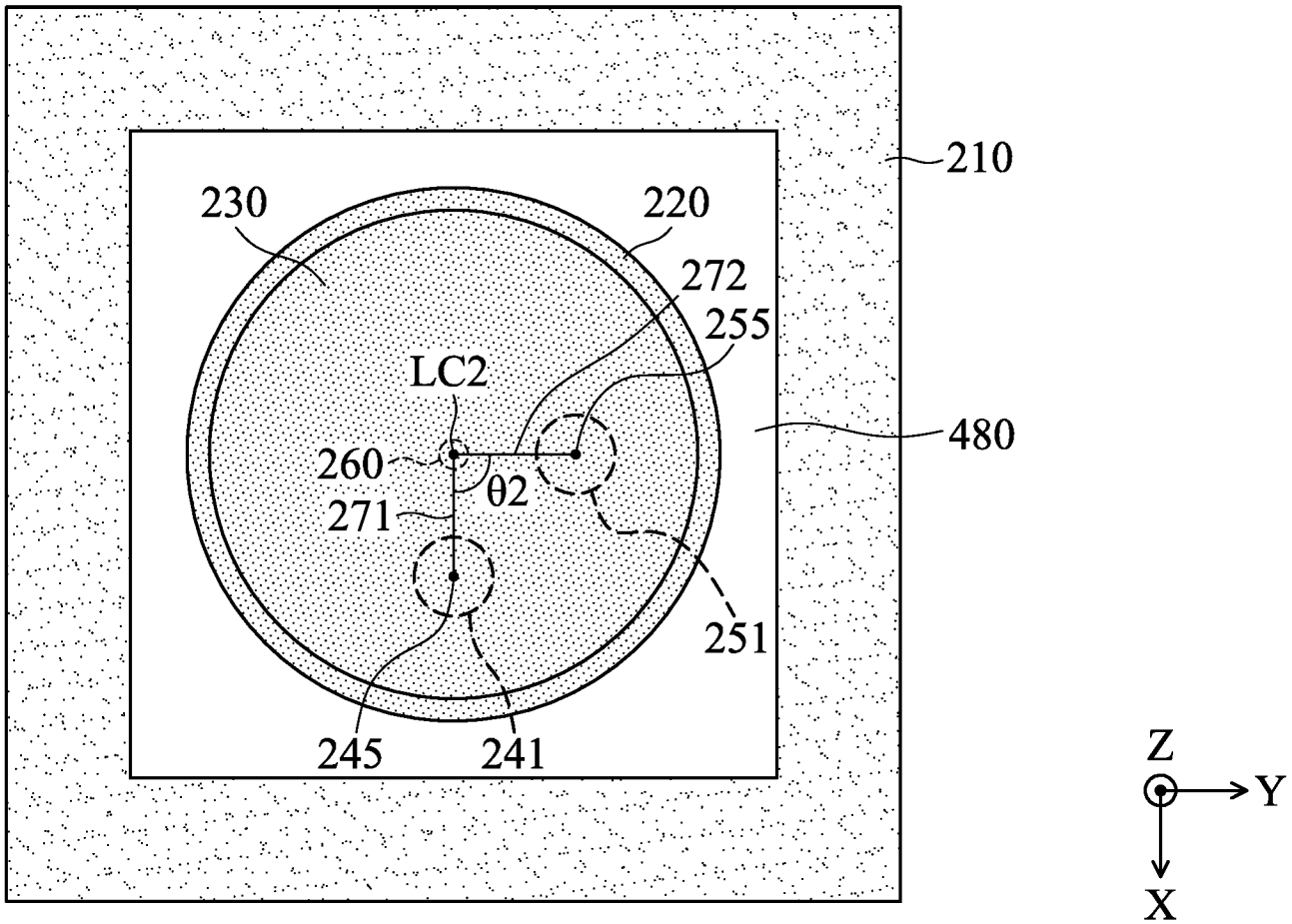
FIG. 4B is a top view of an antenna structure according to another embodiment of the invention.
Figure 4C:
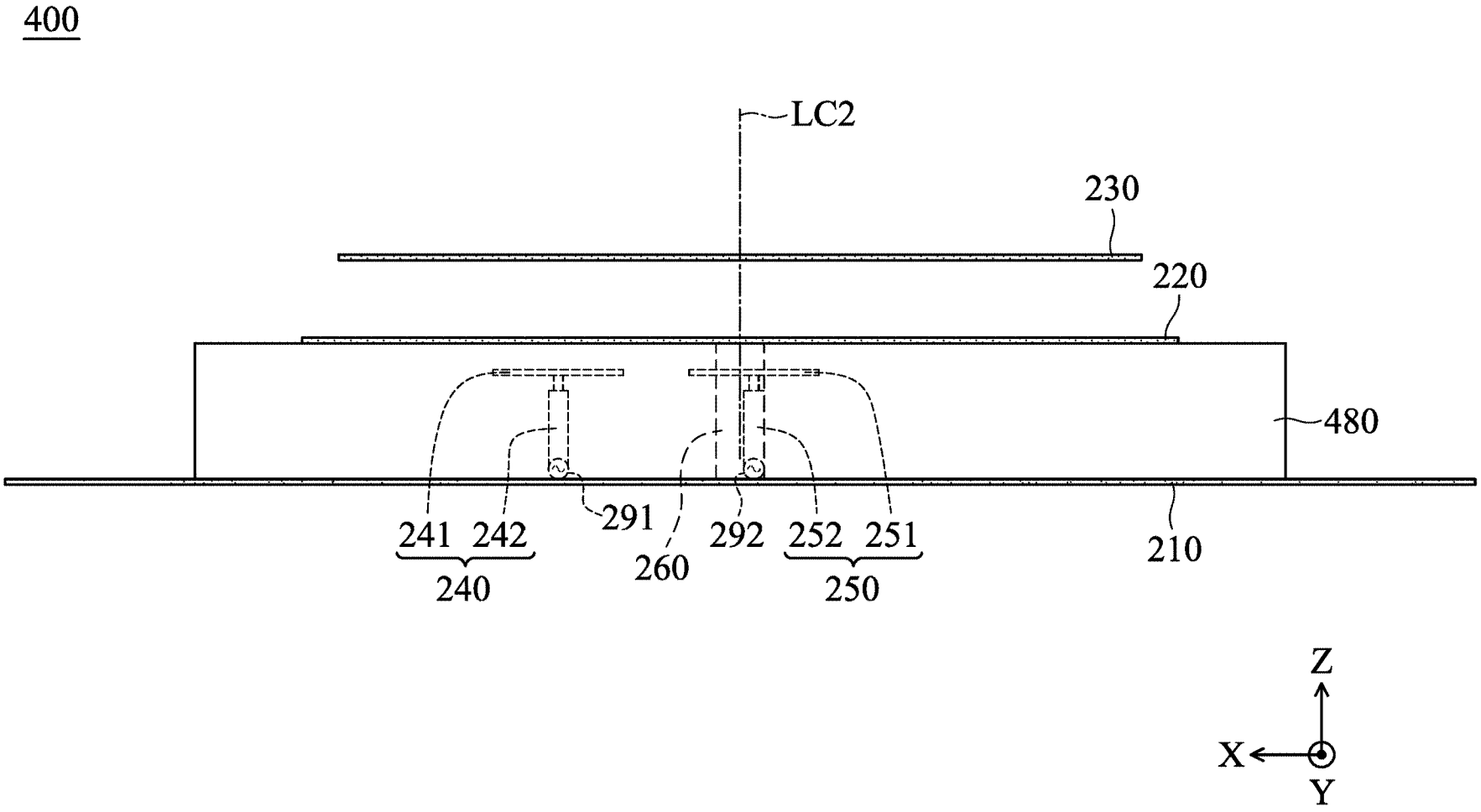
FIG. 4C is a side view of an antenna structure according to another embodiment of the invention.
Figure 4D:
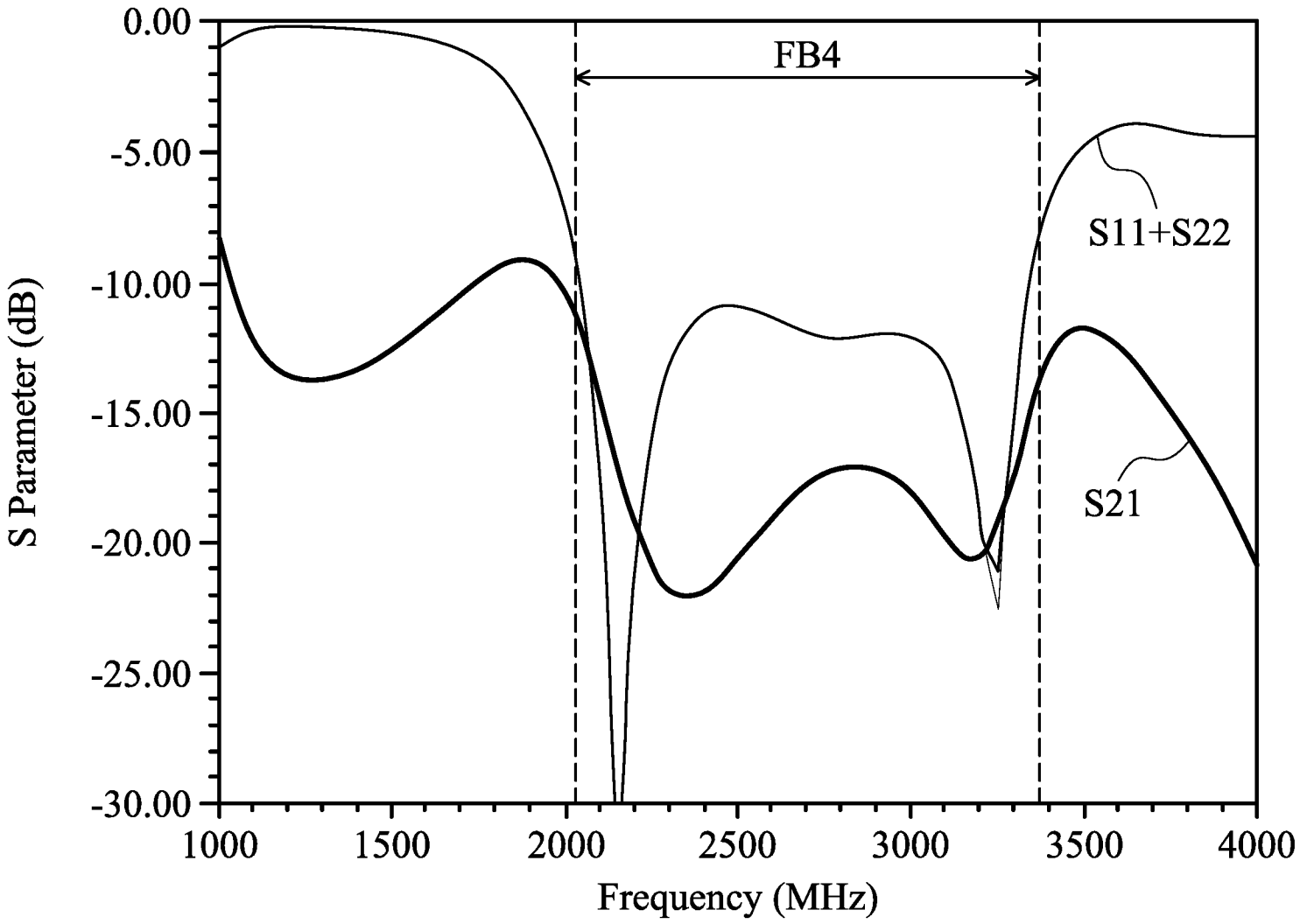
FIG. 4D is a diagram of S parameters of an antenna structure according to another embodiment of the invention.

FIG. 4A is a perspective view of an antenna structure 400 according to another embodiment of the invention. FIG. 4B is a top view of the antenna structure 400 according to another embodiment of the invention. FIG. 4C is a side view of the antenna structure 400 according to another embodiment of the invention. Please refer to FIG. 4A, FIG. 4B, and FIG. 4C together. FIG. 4A, FIG. 4B, and FIG. 4C are similar to FIG. 2A, FIG. 2B, and FIG. 2C. The difference between them is that the antenna structure 400 further includes a dielectric substrate 480 disposed between the first radiation element 220 and the ground element 210. FIG. 4D is a diagram of S parameters of the antenna structure 400 according to another embodiment of the invention. According to the S11 and S22 parameters of FIG. 4D, when the antenna structure 400 is fed by both the first signal source 291 and the second signal source 292, the antenna structure 400 is capable of covering an operation frequency band FB4 from 2050 MHz to 3350 MHz, and the bandwidth of the antenna structure 400 is about 48.1%. Therefore, the incorporation of the dielectric substrate 480 further broadens the operation frequency range of the antenna structure 400. Other features of the antenna structure 400 of FIG. 4A, FIG. 4B, and FIG. 4C are similar to those of the antenna structure 200 of FIG. 2A, FIG. 2B, and FIG. 2C. Accordingly, the two embodiments can achieve similar levels of performance.

It should be noted that once the dielectric substrate 380 (or 480) is added, every "wavelength" relative to the element sizes of the aforementioned antenna structure 100 (or 200) should be adjusted according to the dielectric constant of the dielectric substrate 380 (or 480), as the following equation (1).

$$\lambda_g = \frac{\lambda}{\sqrt{\varepsilon_r}} \tag{1}$$

where "$\lambda_g$" represents the effective wavelength of the central operation frequency of the antenna structure 300 (or 400) operating in the dielectric substrate 380 (or 480), "A" represents the wavelength of the central operation frequency of the antenna structure 100 (or 200) operating in free space, and "$\varepsilon_r$" represents the dielectric constant of the dielectric substrate 380 (or 480).

The invention proposes a novel dual-coupled-fed antenna structure, which has at least the advantages of wide bandwidth, dual polarizations, high isolation, simple structure, and low manufacturing cost. Therefore, the invention is suitable for application in a variety of indoor environments, so as to solve the problem of poor communication quality due to signal reflection and multipath fading in conventional designs.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-4. The invention may merely include any one or more features of any one or more embodiments of FIGS. 1-4. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground element;

a first radiation element, having a first opening and a second opening;

a second radiation element, separated from the first radiation element, wherein the first radiation element is positioned between the second radiation element and the ground element;

a first feeding element, comprising a first coupling excitation element and a first connection element, wherein a first signal source is coupled through the first connection element to the first coupling excitation element, wherein the first connection element passes through the first opening, and wherein the first coupling excitation element is adjacent to the first radiation element and is positioned between the second radiation element and the first radiation element; and a second feeding element, comprising a second coupling excitation element and a second connection element, wherein a second signal source is coupled through the second connection element to the second coupling excitation element, wherein the second connection element passes through the second opening, and wherein the second coupling excitation element is adjacent to the first radiation element and is positioned between the second radiation element and the first radiation element;

wherein a first line segment is formed by connecting a central point of the first coupling excitation element to a central axis of the antenna structure, wherein a second line segment is formed by connecting a central point of the second coupling excitation element to the central axis of the antenna structure, and wherein an angle between the first line segment and the second line segment is greater than 90 degrees.

2. The antenna structure as claimed in claim 1, wherein the first radiation element has a first circular shape, wherein the second radiation element has a second circular shape, and wherein an area of the second circular shape is slightly smaller than an area of the first circular shape.

3. The antenna structure as claimed in claim 2, wherein a radius of each of the first circular shape and the second circular shape is substantially equal to 0.25 wavelength of a central operation frequency of the antenna structure.

4. The antenna structure as claimed in claim 1, wherein the ground element has a square shape.

5. The antenna structure as claimed in claim 1, wherein the first coupling excitation element has a third circular shape, wherein the second coupling excitation element has a fourth circular shape, and wherein an area of the fourth circular shape is equal to an area of the third circular shape.

6. The antenna structure as claimed in claim 1, wherein a length of the first line segment and a length of the second line segment are equal.

7. The antenna structure as claimed in claim 1, wherein a length of each of the first line segment and the second line segment is smaller than or equal to 0.125 wavelength of a central operation frequency of the antenna structure.

8. The antenna structure as claimed in claim 1, wherein the angle between the first line segment and the second line segment is exactly 98 degrees.

9. The antenna structure as claimed in claim 1, further comprising:

a supporting pillar, connected to the ground element, and configured to support the first radiation element.

10. The antenna structure as claimed in claim 1, further comprising:

a dielectric substrate, disposed between the first radiation element and the ground element.

11. An antenna structure, comprising:

a ground element;

a first radiation element;

a second radiation element, separated from the first radiation element, wherein the first radiation element is positioned between the second radiation element and the ground element;

a first feeding element, comprising a first coupling excitation element and a first connection element, wherein a first signal source is coupled through the first connection element to the first coupling excitation element, and wherein the first coupling excitation element is adjacent to the first radiation element and is positioned between the first radiation element and the ground element; and a second feeding element, comprising a second coupling excitation element and a second connection element, wherein a second signal source is coupled through the second connection element to the second coupling excitation element, and wherein the second coupling excitation element is adjacent to the first radiation element and is positioned between the first radiation element and the ground element;

wherein a first line segment is formed by connecting a central point of the first coupling excitation element to a central axis of the antenna structure, wherein a second line segment is formed by connecting a central point of the second coupling excitation element to the central axis of the antenna structure, and wherein an angle between the first line segment and the second line segment is greater than 90 degrees.

12. The antenna structure as claimed in claim 11, wherein the first radiation element has a first circular shape, wherein the second radiation element has a second circular shape, and wherein an area of the second circular shape is slightly smaller than an area of the first circular shape.

13. The antenna structure as claimed in claim 12, wherein a radius of each of the first circular shape and the second circular shape is substantially equal to 0.25 wavelength of a central operation frequency of the antenna structure.

14. The antenna structure as claimed in claim 11, wherein the ground element has a square shape.

15. The antenna structure as claimed in claim 11, wherein the first coupling excitation element has a third circular shape, wherein the second coupling excitation element has a fourth circular shape, and wherein an area of the fourth circular shape is equal to an area of the third circular shape.

16. The antenna structure as claimed in claim 11, wherein a length of the first line segment and a length of the second line segment are equal.

17. The antenna structure as claimed in claim 11, wherein a length of each of the first line segment and the second line segment is smaller than or equal to 0.125 wavelength of a central operation frequency of the antenna structure.

18. The antenna structure as claimed in claim 11, wherein the angle between the first line segment and the second line segment is exactly 94 degrees.

19. The antenna structure as claimed in claim 11, further comprising:

a supporting pillar, connected to the ground element, and configured to support the first radiation element.

20. The antenna structure as claimed in claim 11, further comprising:

a dielectric substrate, disposed between the first radiation element and the ground element.

* * * * *